US008562454B2

(12) United States Patent
Burch

(10) Patent No.: US 8,562,454 B2
(45) Date of Patent: Oct. 22, 2013

(54) GOLF SHAFT CONNECTOR WITH SHAFT INSERTION

(75) Inventor: Eric Burch, Rockford, IL (US)

(73) Assignee: Club-Conex, Inc., Loves Park, IL (US)

( * ) Notice: Subject to any disclaimer, the term of this patent is extended or adjusted under 35 U.S.C. 154(b) by 260 days.

(21) Appl. No.: 13/038,133

(22) Filed: Mar. 1, 2011

(65) Prior Publication Data

US 2012/0225729 A1 Sep. 6, 2012

(51) Int. Cl.
*A63B 53/02* (2006.01)

(52) U.S. Cl.
USPC ..... 473/307; 473/288

(58) Field of Classification Search
USPC ..... 473/288, 307, 244–248, 239, 293–299
See application file for complete search history.

(56) References Cited

U.S. PATENT DOCUMENTS 682,960 A 9/1901 Slazenger
1,543,636 A 6/1925 Williamson
1,565,069 A 12/1925 Edwards
1,585,907 A 5/1926 Miller
2,231,847 A 2/1941 Dickson et al.
2,463,053 A 3/1949 Pritchard
2,464,850 A 3/1949 Crawshaw
3,170,691 A 2/1965 Pritchard
3,947,041 A 3/1976 Barber
4,340,227 A 7/1982 Dopkowski
5,137,275 A 8/1992 Nelson
5,275,408 A * 1/1994 Desbiolles et al. ..... 473/312
5,390,921 A 2/1995 De Ruyter
5,395,109 A * 3/1995 Fenton, Jr. ..... 473/324
5,429,358 A * 7/1995 Rigal et al. ..... 473/309
5,588,921 A * 12/1996 Parsick ..... 473/299
5,863,260 A 1/1999 Butler, Jr. et al.
5,951,411 A 9/1999 Wood et al.
5,971,865 A * 10/1999 Shenoha et al. ..... 473/316
6,039,659 A 3/2000 Hamm
6,343,999 B1 2/2002 Murtland et al.

(Continued)

FOREIGN PATENT DOCUMENTS

JP 2008245669 A * 10/2008
WO WO 04/000424 A1 12/2003

(Continued)

OTHER PUBLICATIONS

U.S. Appl. No. 12/971,192, filed Dec. 17, 2010, Burch.

(Continued)

*Primary Examiner* — Stephen L. Blau
(74) *Attorney, Agent, or Firm* — Reinhart Boerner Van Deuren P.C.

(57) ABSTRACT

A connector of a golf club is provided. The connector includes a shaft adapter and a hosel adapter. A compression nut fits over both adapters to secure them against one another. The hosel adapter advantageously fits over the hosel, thereby allowing the bore of the hosel to remain unmodified from its original design. The connector also includes an anti-rotation arrangement to prevent relative rotation between the shaft adapter and the hosel adapter. Further, the tip end of the club shaft passes entirely through the connector and seats within the hosel as it normally would in the absence of the connector. The connector does not surround the tip end of the shaft where it seats in the hosel, giving the club an unaltered feel, despite the inclusion of the connector.

16 Claims, 4 Drawing Sheets

(56) References Cited

U.S. PATENT DOCUMENTS

| | | | | |
|---|---|---|---|---|
| D477,487 | S | 7/2003 | Chaney et al. | |
| D477,955 | S | 8/2003 | Chaney et al. | |
| D478,140 | S | 8/2003 | Burrows | |
| D478,233 | S | 8/2003 | Chaney et al. | |
| D478,951 | S | 8/2003 | Burrows | |
| D482,087 | S | 11/2003 | Burrows | |
| D482,089 | S | 11/2003 | Burrows | |
| D482,090 | S | 11/2003 | Burrows | |
| D482,094 | S | 11/2003 | Burrows | |
| D482,419 | S | 11/2003 | Burrows | |
| D482,420 | S | 11/2003 | Burrows | |
| D483,826 | S | 12/2003 | Burrows | |
| D484,208 | S | 12/2003 | Burrows | |
| 6,692,375 | B2 | 2/2004 | Abe | |
| 6,746,341 | B1 | 6/2004 | Hamric, Jr. et al. | |
| 6,797,106 | B2 | 9/2004 | Lenhof et al. | |
| 6,890,269 | B2 * | 5/2005 | Burrows | 473/307 |
| 7,083,529 | B2 | 8/2006 | Cackett et al. | |
| 7,207,897 | B2 | 4/2007 | Burch et al. | |
| 7,427,239 | B2 * | 9/2008 | Hocknell et al. | 473/307 |
| 7,789,766 | B2 | 9/2010 | Morris et al. | |
| 7,789,769 | B2 * | 9/2010 | Sugimoto | 473/307 |
| 7,857,709 | B2 | 12/2010 | Burch | |
| 8,057,320 | B2 * | 11/2011 | Bennett et al. | 473/246 |
| 8,142,306 | B2 * | 3/2012 | De La Cruz et al. | 473/288 |
| 2003/0050132 | A1 | 3/2003 | Wilbur | |
| 2003/0153398 | A1 | 8/2003 | Tseng | |
| 2003/0181255 | A1 | 9/2003 | Ho | |
| 2004/0018886 | A1 | 1/2004 | Burrows | |
| 2004/0018887 | A1 | 1/2004 | Burrows | |
| 2005/0176521 | A1 * | 8/2005 | Burch et al. | 473/305 |
| 2007/0017334 | A1 | 1/2007 | Hebestreit et al. | |
| 2007/0173344 | A1 | 7/2007 | Burch | |
| 2008/0254908 | A1 * | 10/2008 | Bennett et al. | 473/288 |
| 2008/0254909 | A1 | 10/2008 | Callinan et al. | |
| 2008/0293510 | A1 * | 11/2008 | Yamamoto | 473/308 |
| 2009/0247316 | A1 * | 10/2009 | De La Cruz et al. | 473/306 |
| 2010/0197423 | A1 * | 8/2010 | Thomas et al. | 473/307 |
| 2011/0256951 | A1 * | 10/2011 | Soracco et al. | 473/307 |
| 2012/0231896 | A1 * | 9/2012 | Seluga et al. | 473/314 |

FOREIGN PATENT DOCUMENTS

| | | | |
|---|---|---|---|
| WO | WO 04/000425 | A1 | 12/2003 |
| WO | WO 2004/009181 | A2 | 1/2004 |
| WO | WO 2004/009186 | A1 | 1/2004 |

OTHER PUBLICATIONS http://www.clubconex.com/images/FUSE-FIT_Hosel_Adapter_Installation_REV1.pdf; date available online Dec. 2010.

http://www.clubconex.com/imapes/FUSE-FIT_Shaft_Adapter_Installation_REV.pdf; date available online Dec. 2010.

2004 PGA Merchandise Show News (magazine); Jan. 31, 2004; cover and pp. 40-41; Publisher: GGRW Inc., Norwalk, CT.

Henry-Griffitts, Inc.; HG Timeline (internet reference); Feb. 20, 2006; 2 pages; www.henry-griffitts.com.

Henry-Griffitts, Inc.; Golf Training Center (internet reference); Feb. 20, 2006; 1 page; www.henry-griffitts.com.

Henry-Griffitts, Inc.; True Temper and Henry-Griffitts Team Up to Produce Breakthrough Clubfitting System (internet reference); Feb. 20, 2006; 1 page; www.truetemper.com.

* cited by examiner

GOLF SHAFT CONNECTOR WITH SHAFT INSERTION

FIELD OF THE INVENTION

This invention generally relates to golf clubs, and more particularly to connectors used between a shaft of the golf club and the club head.

BACKGROUND OF THE INVENTION

A contemporary golf club has two major components: the shaft and the club head. The club head includes a hosel having a bore that receives the tip end of the shaft when the club is assembled. The tip end of the shaft is typically secured in the hosel using an epoxy.

The sizing of the tip end of the shaft as well as the bore of the hosel is generally standardized in the industry. As a result, these components are interchangeable, i.e. different shafts may be combined with different club heads. This interchangeability allows golfers to customize their clubs to their liking by experimenting with various combinations of shafts and club heads.

Various golf club manufacturers such as Callaway, Nike Golf, Alpha Golf, and Taylor Made have devised connectors that take advantage of this interchangeability by expediting the joining process. Typically, these connectors mount with the hosel of the club head and the tip end of the shaft, and are used to rapidly and removeably join the shaft and club head without the use of epoxy. These connectors have been recognized as providing an advantage to club retailers, as golfers can try various combinations of shafts and club heads in a single visit to a retail store.

Unfortunately, these connectors have significant deficiencies. For example, the portion of the connector that mounts with the hosel of the club head is typically received in the bore of the hosel. This portion of the hosel is ordinarily occupied by the tip end of the shaft alone when a connector is not employed. Such a configuration creates at least two problems.

First, the shaft is surrounded by the connector within the hosel. It has been observed that this configuration changes the design dynamics of the club. It has also been observed that such a configuration creates a metallic, mute, or harsh feel when striking a golf ball.

Second, the bore of the hosel must be bored out or otherwise modified to accommodate the connector and the tip end of the shaft therein. This problem arises because the tip end of the shaft and the hosel are ordinarily sized to snugly mate with one another. Put another way, the inner diameter of the hosel bore is only slightly larger than the outer diameter of the tip end of the shaft.

As a result, the hosel bore must be increased to receive the connector and the shaft. Alternatively, golf club manufacturers must manufacture custom club heads having non-standard hosel bores specifically designed to accommodate the size of a particular style of connector. It goes without saying that this alternative is equally disadvantageous as the problems noted above.

Therefore, there is a need in the art for a connector for a golf club that overcomes the noted problems in the art. The invention provides such a connector. These and other advantages of the invention, as well as additional inventive features, will be apparent from the description of the invention provided herein.

BRIEF SUMMARY OF THE INVENTION

In one aspect, the invention provides a golf club connector for releasably securing a golf club shaft and a club head having a hosel with a bore. The connector includes a shaft adapter having a bore sized and configured to receive the golf club shaft. The connector also has a hosel adapter having a bore sized and configured to receive the hosel such that the hosel is positioned within the bore of the hosel adapter. The connector also includes a compression nut threadably engaging the hosel adapter, the compression nut engaging the shaft adapter to axially bias the shaft adapter into engagement with the hosel adapter.

In certain embodiments, the shaft adapter has a first bore, and the hosel adapter has a second bore and a third bore having a greater diameter than the second bore, the first bore receiving a portion of the golf club shaft, the second bore receiving another portion of the golf club shaft and the hosel. In certain embodiments, the hosel adapter further comprises an annular seat positioned between the second and third bores, the annular seat having an abutment surface that is generally perpendicular to a longitudinal axis of the hosel adapter. Further, the abutment surface of the annular seat is configured to abut an axial end of the hosel such that the hosel does not extend into the second bore.

In certain embodiments, the shaft adapter has a first bore, the hosel adapter has a second and a third bore, and wherein the first, second, and third bores are axially aligned such that the connector has a continuous bore therethrough.

In certain embodiments, the connector further includes an anti-rotation arrangement formed between the shaft adapter and the hosel adapter for preventing relative rotation between the shaft adapter and hosel adapter.

In another aspect, a golf club connector for releasably securing a golf club shaft and a club head having a hosel with a bore is provided. The connector includes a shaft adapter having an annular wall and a first anti-rotation member formed on the annular wall. The connector also includes a hosel adapter having an annular wall and a second anti-rotation member formed on the annular wall. The shaft and hosel adapter are rotatably fixed relative to one another through engagement of the first and second anti-rotation members. The first and second anti-rotation members mate to define a portion of a continuous bore extending between the shaft adapter and the hosel adapter.

In certain embodiments, the first and second anti-rotation members are configured to mate to allow passage of the golf club shaft through the continuous bore. In certain embodiments, the first and second anti-rotation members are keyed to one another such that the second anti-rotation member receives the first anti-rotation member.

In certain embodiments, the first anti-rotation member includes at least one axial projection projecting from an axial abutment surface of the shaft adapter. The second anti-rotation member includes at least one axially extending pocket extending from an axial abutment surface of the hosel adapter. In certain embodiments, the at least one axial projection is a pair of generally rectangular keys, and wherein the at least one axially extending pocket is a pair of generally rectangular cutouts.

In certain embodiments, the pair of generally rectangular keys are angularly positioned about a longitudinal axis of the shaft adapter at about 180° relative to one another. The generally rectangular cutouts are angularly positioned about a longitudinal axis of the hosel adapter at about 180° relative to one another.

In certain embodiments, the hosel adapter includes a hosel receiving portion and a threaded portion axially extending from the hosel receiving portion. The cutouts are formed in the threaded portion.

In certain embodiments, the shaft adapter has a stepped outer diameter with a radially projecting ring formed proximate an end of the shaft adapter. The shaft adapter has a constant inner diameter such that the shaft adapter has a greater wall thickness at the radially projecting ring than at the remainder of the shaft adapter. The pair of generally rectangular keys extend axially away from the radially projecting ring. In certain embodiments, the radially projecting ring includes a seating surface at an end thereof opposite the end from which the pair of generally rectangular pair of keys extend from.

In certain embodiments, the connector further includes a compression nut for joining the shaft adapter with the hosel adapter. The compression nut has a continuous bore fore receipt of a portion of the shaft adapter and of a portion of the hosel adapter. A biasing surface is formed within the continuous bore of the compression nut. The biasing surface abuts the seating surface to axially bias the shaft adapter into engagement with the hosel adapter.

In yet another aspect, a system for assembling a golf club is provided. The system includes a golf club shaft and a golf club head having a hosel. The hosel has a bore for receiving an end of the golf club shaft. The system also includes a shaft adapter having a first bore for receiving the golf club shaft. The system also includes a hosel adapter having a second bore and a third bore. A portion of the golf club shaft is positioned in the second bore. A portion of the golf club shaft and a portion of the hosel are positioned within the third bore.

In certain embodiments, the first bore has a same bore diameter as the second bore. In certain embodiments, the third bore has a bore diameter greater than the bore diameters of the first and second bores. In certain embodiments, the first, second, and third bores are axially aligned such that the golf club shaft extends through each of the first, second, and third bore diameters and seats against a bottom surface of the hosel bore below a bottom edge of the hosel adapter.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
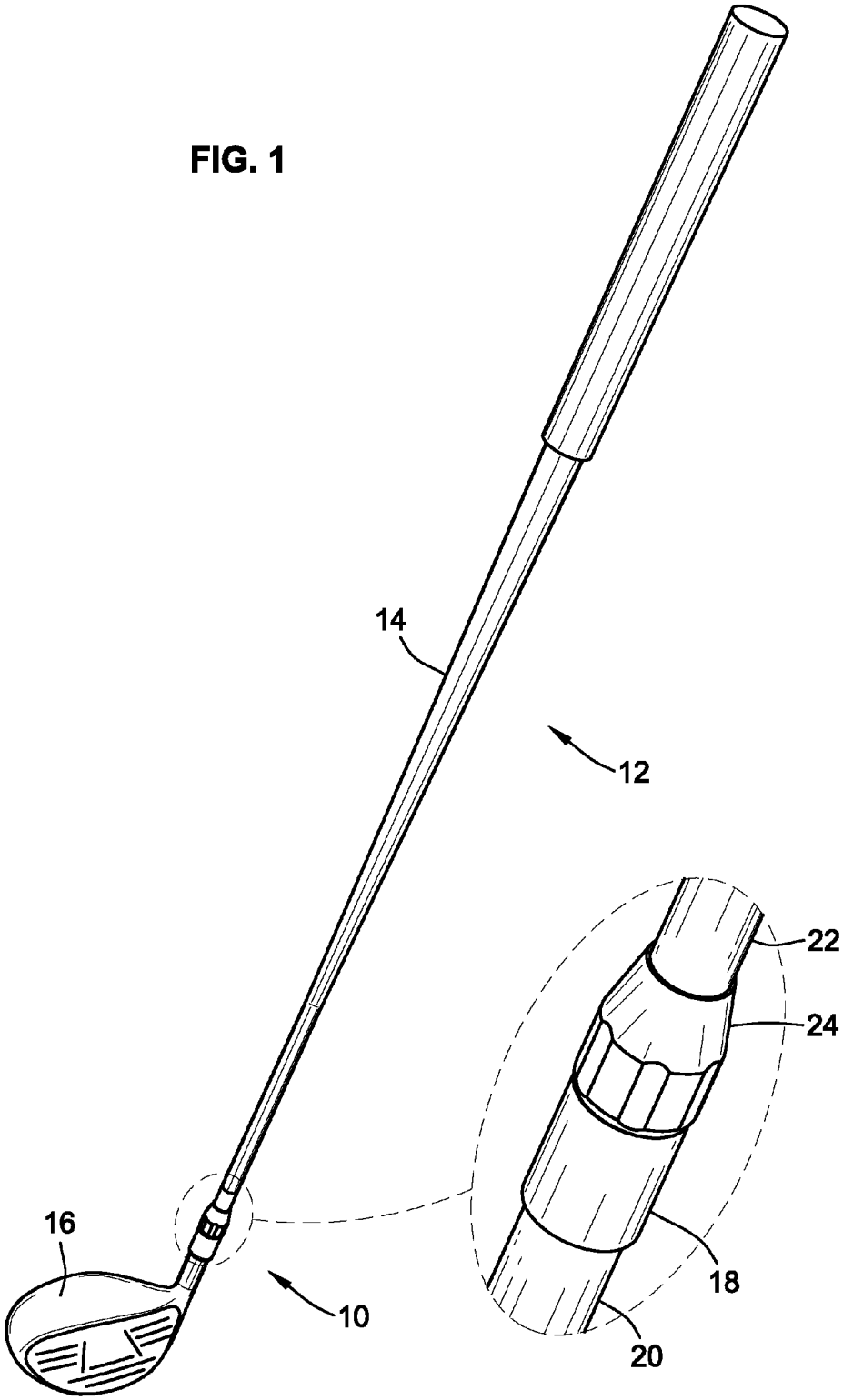
FIG. 1 is a perspective view of a golf club employing an exemplary embodiment of a connector according to the teachings of the present invention.

Turning now to the drawings, there is illustrated in FIG. 1 an exemplary embodiment of a connector 10 according to the teachings of the present invention. The connector 10 is installed on a golf club 12. It will be recognized from the following description that the connector 10 is not limited in any way to the particular golf club 12 illustrated. Indeed, the connector 10 may be advantageously employed with various types of golf clubs. As such, the particular golf club 12 illustrated is provided for purposes of description and does not limit embodiments of the invention in any way.

Still referring to FIG. 1, the connector 10 is positioned between the golf club shaft 14 and the club head 16. As will be better understood from the following, the connector 12 advantageously joins the shaft 14 with the club head 16 without any modification of either of these components. As such, the connector 10 can readily be integrated with "off the shelf" clubs.

Further, the connector 10 leaves the dynamics and feel of the club unchanged by incorporating a hosel adapter 18 that fits over a hosel 20 of the club head 16. Similarly, the connector 10 incorporates a shaft adapter 22 that fits over the shaft 14 of the golf club 12. The hosel adapter 18 and shaft adapter 22 are joined by way of a compression nut 24. The shaft adapter 22, hosel adapter 18, and compression nut 24 will be described in turn in the following.

Figure 2:
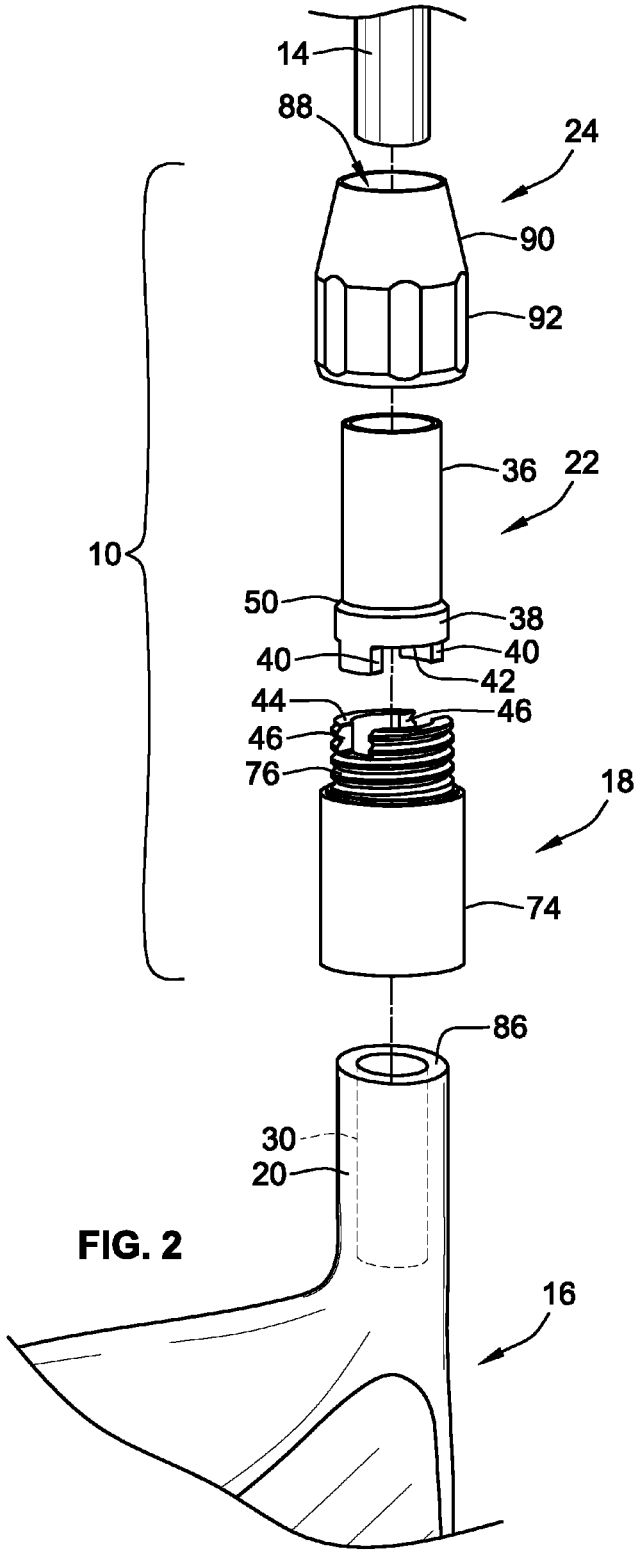
FIG. 2 is a perspective exploded view of the connector of FIG. 1, and it is installed on the golf club.

Turning first to the shaft adapter 22, and with reference now to FIG. 2, the shaft adapter 22 is generally cylindrical in shape. The shaft adapter 22 has a generally stepped outer diameter 36. The stepped outer diameter 36 of the shaft adapter 22 has radial projection 38. A first anti-rotational member in the form of a pair of keys 40 is formed proximate the radial projection 38 and extends from an axial face 42 thereof.

Figure 3:
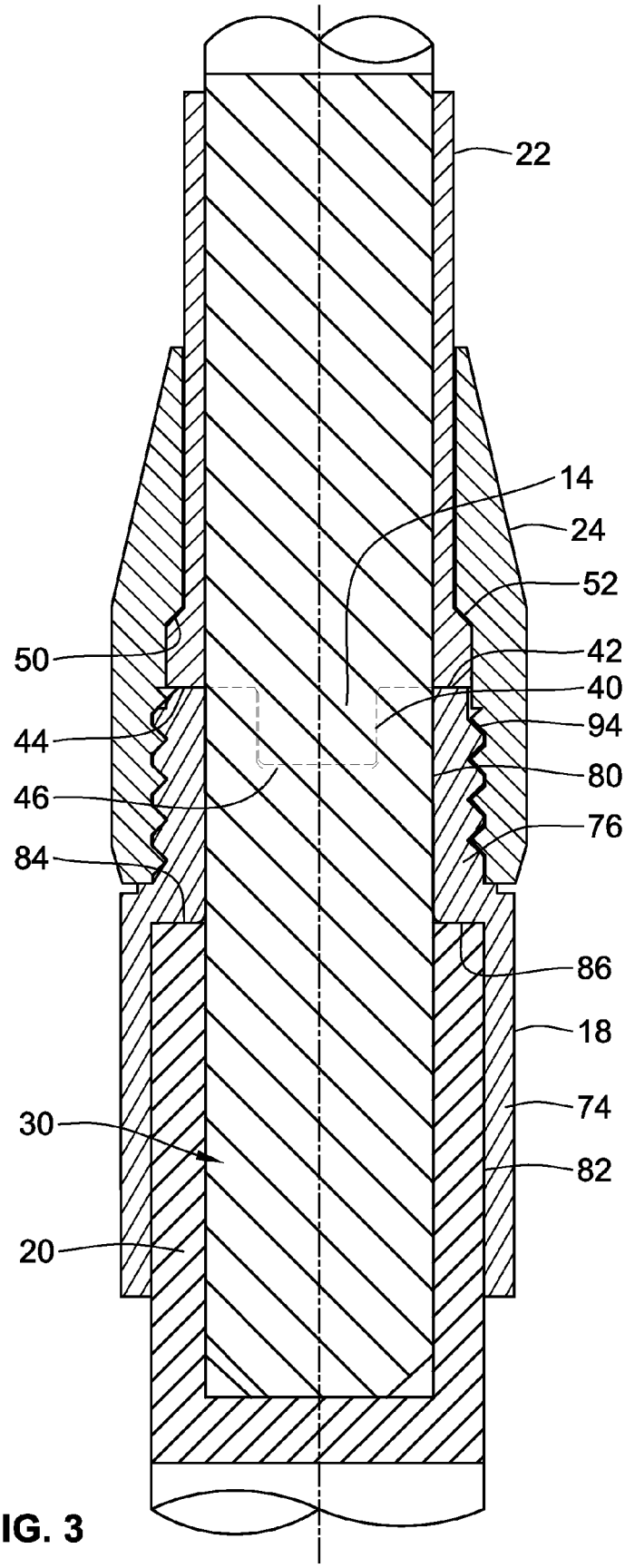
FIG. 3 is a cross section of the connector of FIG. 1.

With reference to FIG. 3, the axial face 42 of the shaft adapter 22 abuts a corresponding axial face 44 of the hosel adapter 18. As will be explained in greater detail below, the hosel adapter 18 includes a second anti-rotation member in the form of a pair of cut outs 46 for receipt of the pair of keys 40. Such a configuration prevents the relative rotation between the shaft adapter 22 and hosel adapter 18.

Turning back to FIG. 2, the shaft adapter 22 also includes a seating surface 50 on which the compression nut 24 seats against to bias the shaft adapter 22 into axial engagement with the hosel adapter 18. With reference to FIG. 3, the compression nut 24 includes a biasing surface 52 that seats against the seating surface 50 of the shaft adapter 22. As can best be seen in FIG. 3, both the biasing surface 50 and seating surface 52 are angled greater than 90° relative to vertical, but could be formed at right angles in other embodiments.

Figure 4:
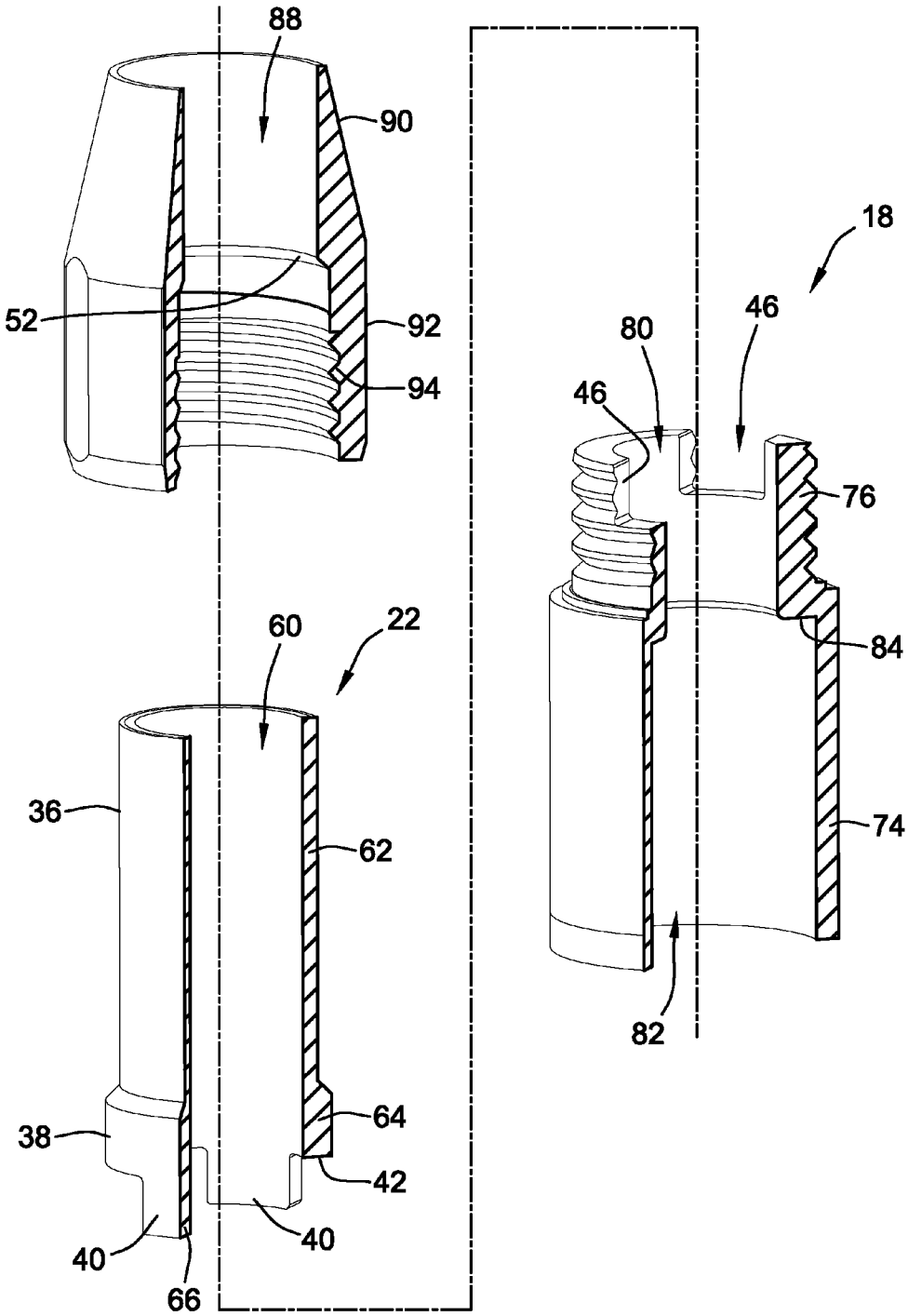
FIG. 4 is a perspective exploded cross section of the connector of FIG. 1.

With reference now to FIG. 4, the shaft adapter 22 has a first bore in the form of a smooth and constant inner diameter 60. As such, the stepped outer diameter 36 of the shaft adapter 22 results in a first wall thickness 62 and a second wall thickness 64 greater than the first wall thickness 62 in the region of the radial projection 38. As can best be seen at FIG. 4, the keys 40 have a key thickness 66 that is generally equivalent to the second wall thickness 64. However, it will be recognized that the key thickness need not be the same as the second wall thickness 64 to provide the anti-rotation functionality as described herein.

The smooth inner diameter 60 of the shaft adapter 22 is sized to receive the shaft 14 of the golf club 12 (see FIG. 1). The smooth inner diameter 60 and the shaft 14 mate such that there is little to no play between the shaft 14 and shaft adapter 22. Further, the shaft adapter 22 can be affixed to the shaft 14 using an epoxy. As a result, the shaft adapter 22 may be securely fastened to the shaft 14, but later be removed by removing the cured epoxy.

The shaft adapter 22 can be manufactured from a variety of materials including plastic, metal, etc. Indeed, any material that is sufficiently rigid for mounting and later operation of the golf club 12 will suffice. As one example, the shaft adapter 22 may be injection molded. All of the structural features described herein relative to the shaft adapter 22 may be implemented in a single operation such as injection molding, or later manufacturing processes may be employed to achieve the shape described and shown herein. Additionally, although not shown, the outer surface of the shaft adapter 22 can also include an alignment or a "clocking" mark for rotatably aligning the shaft adapter 22 relative to the shaft 14.

Having described the structural attributes of the shaft adapter 22, description of the hosel adapter 18 will now be provided. With reference back to FIG. 2, the hosel adapter 18 is also generally cylindrical in shape. The hosel adapter 18 includes a hosel receiving portion 74 and a male threaded portion 76 extending from the hosel receiving portion 74. As illustrated in FIG. 2, the aforementioned cut outs 46 are formed in the male threaded portion 76. Also as illustrated, the cut outs 46 extend axially from the axial face 44 of the hosel adapter 18.

Although the cut outs 46 have a generally rectangular shape, it will be recognized that such a shape is not in any way limiting on the invention. Indeed, the cut outs 46 can be a variety of shapes, as is true for the keys 40 of the shaft adapter 22. Further, fewer or more cut outs 46 and keys 40 may be employed. Still further, the location of the keys 40 and cut outs 46 may be reversed such that the keys are presented on the hosel adapter 18 and the cut outs are presented on the shaft adapter 22.

With additional reference to FIG. 3, the keys 40 of the shaft adapter 22 are shown bottomed out in the cut outs 46 of the hosel adapter 18. It will be recognized however, that the keys 40 may not project into the cut outs 46 such that they bottom out.

As can best be seen at FIG. 3, the hosel adapter 18 has a stepped inner diameter. Indeed, the male threaded portion 76 defines a second bore 80 that has a diameter that is equivalent to the smooth diameter 60 (i.e. the first bore) of the shaft adapter 22. As a result, when the axial face 42 of the shaft adapter 22 abuts the axial face 44 of the hosel adapter 18, a smooth and continuous inner diameter is presented for receipt of the shaft 14 as illustrated. The hosel adapter 18 also has a third bore 82 greater than the second bore 80. The third bore 82 is sized to receive the hosel 20 as well as the shaft 14. Such a configuration advantageously allows the shaft 14 to seat within the hosel bore 30 in the manner in which these items were originally designed.

With reference to FIG. 4, the second and third bores 80, 82 are separated by an annular seat 84. The annular seat 84 is positioned to locate against a top surface 86 of the hosel 20 (see FIG. 2). As can best be appreciated by reference to FIG. 3, the location of the annular seat 84 thus defines the maximum insertion depth of the hosel 20 into the hosel adapter 18.

As was the case with the shaft adapter 22, the hosel adapter 18 can be manufactured by a variety of methods using a variety of materials that are sufficiently rigid to achieve the functionality of the connector as described herein. For example, the hosel adapter 18 may be injection molded. All of the structural features of the hosel adapter 18 described herein may be implemented in a single operation during molding. However, in other embodiments, it is contemplated that certain features may be implemented in multiple manufacturing steps once molding is complete.

Additionally, although not shown, the hosel adapter 18 can also include an alignment or "clocking" mark for rotatably aligning the hosel adapter 18 with the hosel 20, and/or the clocking mark of the shaft adapter 22. Further, it will be recognized that the hosel adapter 18, as well as the shaft adapter 22, can be designed to accommodate hosels and shafts combination of various diameters. Indeed, it will be readily appreciated that the connector 10 can be scaled up or down to meet the design criteria of various clubs 12.

Still further, the hosel adapter 18 and/or the shaft adapter 22 can be designed to have a variable bore so that a single connector 10 can be installed upon hosels and shafts of various diameters. Indeed, such a configuration may be achieved through the use of an insert that fits over the hosel or the shaft to reduce any play between the hosel adapter 18 and hosel, or the shaft adapter 22 and shaft. The insert may be interchangeable such that several inserts are supplied with a connector 10 to accommodate a plurality of hosel and shaft outer diameters. Alternatively, a single, adjustable insert can also be provided to achieve this desired flexibility.

Referring back to FIG. 2, description will now be provided for the compression nut 24. The compression nut 24 has an outer periphery with a tapered section 90 and a knurled section 92. As will be described in greater detail below, the compression nut 24 is threadably received by the male threaded portion 76 of the hosel adapter 18. The knurled section 92 advantageously enhances manual installation of the compression nut 24 onto the hosel adapter 18. The compression nut 24 has a continuous bore 88 therethrough for axially receiving the shaft adapter 22, shaft 14, and the threaded portion 76 of the hosel adapter 18.

Referring back to FIG. 3, as introduced above, the compression nut 24 includes female threads 94 that engage the threads of the male threaded portion 76 of the hosel adapter 18. Such threaded engagement continues until the biasing surface 52 of the compression nut 24 seats against the seating surface 50 of the shaft adapter 22. Such a configuration ensures that the shaft adapter 22 is sufficiently compressed against the hosel adapter 18. Additionally, the interaction between the seating surface 50 and biasing surface 52 provides a positive stop to ensure that the compression nut 24 is not tightened to such an extent as to over compress and damage the shaft adapter 22 or the hosel adapter 18.

With reference again to FIG. 4, also as introduced above, the biasing surface 52 is generally angled. The angle of the biasing surface 52 matches the angle of the seating surface 50 (see FIG. 3). The particular dimension of this angle is not in any way limited, and need only provide the aforementioned biasing and stopping functions as described above.

Having described the various structural attributes of the connector 10, the following describes the general steps for installing the same.

Referring back to FIG. 2, the connector 10 is configured advantageously for rapid installation onto a shaft 14 and club head 16 of a golf club 12. To install the connector 10, the hosel adapter 18 and shaft adapter 22 are first secured to the hosel 20 and shaft 14 respectively. These steps may be performed in any order, and the following description discussing the installation of the hosel adapter 18 first is provided for descriptive purposes only.

Still referring to FIG. 2, to install the hosel adapter 18, epoxy is first applied to the outer diameter of the hosel 20, and/or the surface of the third bore 82 (see FIG. 4) the hosel adapter is then slid over the hosel 20 such that the hosel 20 is received in the third bore 82. This insertion continues until the top surface 86 of the hosel 20 abuts the annular seat 84 of the hosel adapter 18. In embodiments incorporating a clocking mark, rotational alignment between the hosel adapter 18 and the hosel 20 is also achieved at this stage.

To install the shaft adapter 22, the same is passed through the continuous bore 88 of the compression nut 24 until the compression nut 24 loosely rests against the seating surface 50 of the shaft adapter 22. Adhesive or epoxy is then applied to the first bore (i.e. the smooth inner diameter 60) of the shaft adapter 22 and/or the outer diameter of the shaft 14.

The shaft adapter 22 is then slid along the shaft 14 until the tip end of the shaft 14 extends beyond the shaft adapter 22 to such an extent though as to allow shaft adapter 22 to abut the hosel adapter 18 as described above and to allow the tip section of the shaft 14 to fully seat within the hosel bore 30 of the hosel 20. In embodiments incorporating a clocking mark, rotational alignment between the shaft adapter 22 and the shaft 14 and/or the hosel adapter 18 is also achieved at this stage.

Once the hosel adapter 18 and shaft adapter 22 are installed, the same may be joined together via the compression nut 24. More specifically, the shaft 14 is seated in the hosel bore 30 as describe above. Simultaneously, the shaft 14 is rotated while sliding the shaft 14 into the hosel bore 30 such that the keys 40 of the shaft adapter 22 are received in the cut outs 46 of the hosel adapter 18 and the axial face 42 of the shaft adapter 22 abuts the axial face 44 of the hosel adapter 18. Once this abutment is achieved, the compression nut 24 is threaded down on the threaded portion 76 of the hosel adapter 18. Installation of the compression nut 24 continues until the biasing surface 52 engages the seating surface 50 as described above, and the compression nut is fully tightened. This completes the installation of the connector.

To remove the connector 10 a generally reverse process is followed. More specifically, the compression nut 24 is loosened and the shaft 14 is separated from the club head 16. Thereafter, any number of known chemical solutions may be applied to the shaft adapter 22 and hosel adapter 18 to dissolve the epoxy and to remove them from the shaft 14 and club head 16 respectively. It will be recognized that the above process of installation and removal leaves the shaft 14 and club head 16 unaltered and undamaged.

As described herein, aspects of the connector 10 advantageously provide a means for rapidly combining a golf club shaft 14 with a club head 16 without the need of modifying any portions of either of these items unlike prior designs of connectors. Such advantages are achieved, in part, by providing a hosel adapter 18 that fits over a hosel 20 of a club head 16. Such a configuration also advantageously allows golf club shaft 14 to seat within the hosel 20 as it would in the absence of a connector 10. Thus, the design dynamics of the golf club 12 remain generally unaffected by the inclusion of the connector 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A golf club connector for releasably securing a golf club shaft and a club head having a hosel with a bore, comprising:

a shaft adapter having a bore sized and configured to receive the golf club shaft;

a hosel adapter having a bore sized and configured to receive the hosel such that the hosel is positioned within the bore of the hosel adapter; and a compression nut threadably engaging the hosel adapter, the compression nut engaging the shaft adapter to axially bias the shaft adapter into engagement with the hosel adapter.

2. The connector of claim 1, wherein the shaft adapter has a first bore, and the hosel adapter has a second bore and a third bore having a greater diameter than the second bore, the first bore receiving a portion of the golf club shaft, the third bore receiving another portion of the golf club shaft and the hosel.

3. The connector of claim 2, wherein the hosel adapter further comprises an annular seat positioned between the second and third bores, the annular seat having an abutment surface that is generally perpendicular to a longitudinal axis of the hosel adapter.

4. The connector of claim 3, wherein the abutment surface of the annular seat is configured to abut an axial end of the hosel such that the hosel does not extend into the second bore.

5. The connector of claim 1, wherein the shaft adapter has a first bore, the hosel adapter has a second and a third bore, and wherein the first, second, and third bores are axially aligned such that the connector has a continuous bore therethrough.

6. The connector of claim 1, further comprising an anti-rotation arrangement formed between the shaft adapter and the hosel adapter for preventing relative rotation between the shaft adapter and hosel adapter.

7. A golf club connector for releasably securing a golf club shaft and a club head having a hosel with a bore, comprising:

a shaft adapter having an annular wall and a first anti-rotation member formed on the annular wall;

a hosel adapter having an annular wall and a second anti-rotation member formed on the annular wall, the hosel adapter having a bore sized and configured to receive the hosel such that the hosel is positioned within the bore of the hosel adapter; and wherein the shaft and hosel adapter are rotatably fixed relative to one another through engagement of the first and second anti-rotation members, and wherein the first and second anti-rotation members mate to define a portion of a continuous bore extending between the shaft adapter and the hosel adapter.

8. The connector of claim 7, wherein the first and second anti-rotation members are configured to mate to allow passage of the golf club shaft through the continuous bore.

9. The connector of claim 8, wherein the first and second anti-rotation members are keyed to one another such that the second anti-rotation member receives the first anti-rotation member.

10. The connector of claim 9, wherein the first anti-rotation member includes at least one axial projection projecting from an axial abutment surface of the shaft adapter, and wherein the second anti-rotation member includes at least one axially extending pocket extending from an axial abutment surface of the hosel adapter.

11. The connector of claim 10, wherein the at least one axial projection is a pair of generally rectangular keys, and wherein the at least one axially extending pocket is a pair of generally rectangular cutouts.

12. The connector of claim 11, wherein the pair of generally rectangular keys are angularly positioned about a longitudinal axis of the shaft adapter at about 180° relative to one another, and wherein the generally rectangular cutouts are angularly positioned about a longitudinal axis of the hosel adapter at about 180° relative to one another.

13. The connector of claim 11, wherein the hosel adapter includes a hosel receiving portion and a threaded portion axially extending from the hosel receiving portion, and wherein the cutouts are formed in the threaded portion.

14. The connector of claim 11, wherein the shaft adapter has a stepped outer diameter with a radially projecting ring formed proximate an end of the shaft adapter, the shaft adapter having a constant inner diameter such that the shaft adapter has a greater wall thickness at the radially projecting ring than at the remainder of the shaft adapter, and wherein the pair of generally rectangular keys extend axially away from the radially projecting ring.

15. The connector of claim 14, wherein the radially projecting ring includes a seating surface at an end thereof opposite the end from which the pair of generally rectangular pair of keys extend from.

16. The connector of claim 15, wherein the connector further includes a compression nut for joining the shaft adapter with the hosel adapter, the compression nut having a continuous bore fore receipt of a portion of the shaft adapter and of a portion of the hosel adapter, and wherein a biasing surface is formed within the continuous bore of the compression nut, the biasing surface abutting the seating surface to axially bias the shaft adapter into engagement with the hosel adapter.

* * * * *